US007249561B2

(12) United States Patent
Robertson et al.

(10) Patent No.: US 7,249,561 B2
(45) Date of Patent: Jul. 31, 2007

(54) GUARDRAIL ASSEMBLY

(76) Inventors: Malcolm Robertson, 16 Trafalgar Road, Emu Heights, New South Wales 2750 (AU); Edwin Thorneley, 9 Campton Avenue, Cambridge Park, New South Wales 2747 (AU)

( * ) Notice: Subject to any disclaimer, the term of this patent is extended or adjusted under 35 U.S.C. 154(b) by 0 days.

(21) Appl. No.: 10/493,152

(22) PCT Filed: Oct. 16, 2002

(86) PCT No.: PCT/AU02/01415

§ 371 (c)(1),
(2), (4) Date: Apr. 16, 2004

(87) PCT Pub. No.: WO03/033327

PCT Pub. Date: Apr. 24, 2003

(65) Prior Publication Data

US 2004/0255814 A1 Dec. 23, 2004

(30) Foreign Application Priority Data

Oct. 16, 2001 (AU) ..... PR8275

(51) Int. Cl.
*B61B 12/02* (2006.01)

(52) U.S. Cl. ..... 104/242

(58) Field of Classification Search ..... 104/27, 104/30, 124, 125, 126, 242, 307
See application file for complete search history.

(56) References Cited

FOREIGN PATENT DOCUMENTS

| | | | |
|---|---|---|---|
| DE | 44 21 678 A1 | * | 1/1996 |
| DE | 4421678 A1 | * | 1/1996 |
| GB | 2 333 795 A | * | 4/1999 |

* cited by examiner

*Primary Examiner*—S. Joseph Morano
*Assistant Examiner*—Robert J. McCarry, Jr.
(74) *Attorney, Agent, or Firm*—Abelman, Frayne & Schwab

(57) ABSTRACT

A guardrail assembly for securing to a rail of a track has a plurality of post forming means and one or more rail means supported by the plurality of post forming means, each post forming means including locking means slidably insertable under the rail, clamping means adapted to engage against a first side portion of the rail and to be moved between a first position, where the locking means is slidably removable from under the rail, and a second position, where the locking means locks the clamping means to the rail, upright post means, and spacing means connected between the clamping means and the upright post means for locating the upright post means sufficiently remote of the rail to prevent a rail worker encroaching dangerously close to the rail.

5 Claims, 3 Drawing Sheets

GUARDRAIL ASSEMBLY

CROSS-REFERENCE TO RELATED APPLICATIONS

This application is a 371 of PCT/AU02/01415, filed on Oct. 16, 2002.

BACKGROUND OF THE INVENTION

1. Field of the Invention

The invention relates to a guardrail assembly for preventing rail workers encroaching dangerously close to railway tracks which are in use.

2. Description of the Related Art

Many lives have been lost throughout the world as a result of rail workers being hit by oncoming trains. This is particularly the case for rail maintenance crews working on one railway track, whilst an adjacent track is still in use.

In some countries, before work can proceed on one track, a safety barrier must be erected between it and any adjacent track which is in use. Normally, the safety barrier is secured or clamped to the base of the track which is in use and provides a vertical barrier about 1.2 m to 1.8 m from that track.

Such known safety barriers are clamped to the track base and assembled in a time consuming and complicated manner. Moving parts on existing clamping mechanisms for such barriers allow gravel to penetrate and interfere with the working of the clamping mechanism, thereby rendering such barriers ineffective. Furthermore, existing clamping mechanisms require that a large amount of gravel be dug from around the track base to create sufficient room for the clamping mechanism to be inserted and attached.

It is therefore an object of the present invention to provide a guardrail assembly that is quick and easy to install and which avoids the aforementioned specific problems associated with installation of the safety barriers of the prior art.

BRIEF SUMMARY OF THE INVENTION

According to the invention, there is provided a guardrail assembly for securing to a rail of a track, comprising:

(a) a plurality of post forming means, each post forming means including:

(i) locking means slidably insertable under the rail, (ii) clamping means adapted to engage against a first side portion of the rail and to be moved between a first position, where the locking means is slidably removable from under the rail, and a second position, where the locking means locks the clamping means to the rail, (iii) upright post means, and (iv) spacing means connected between the clamping means and the upright post means for locating the upright post means sufficiently remote of the rail to prevent a rail worker encroaching dangerously close to the rail, and (b) one or more rail means supported by the plurality of post forming means.

DETAILED DESCRIPTION OF THE INVENTION

Figure 1:
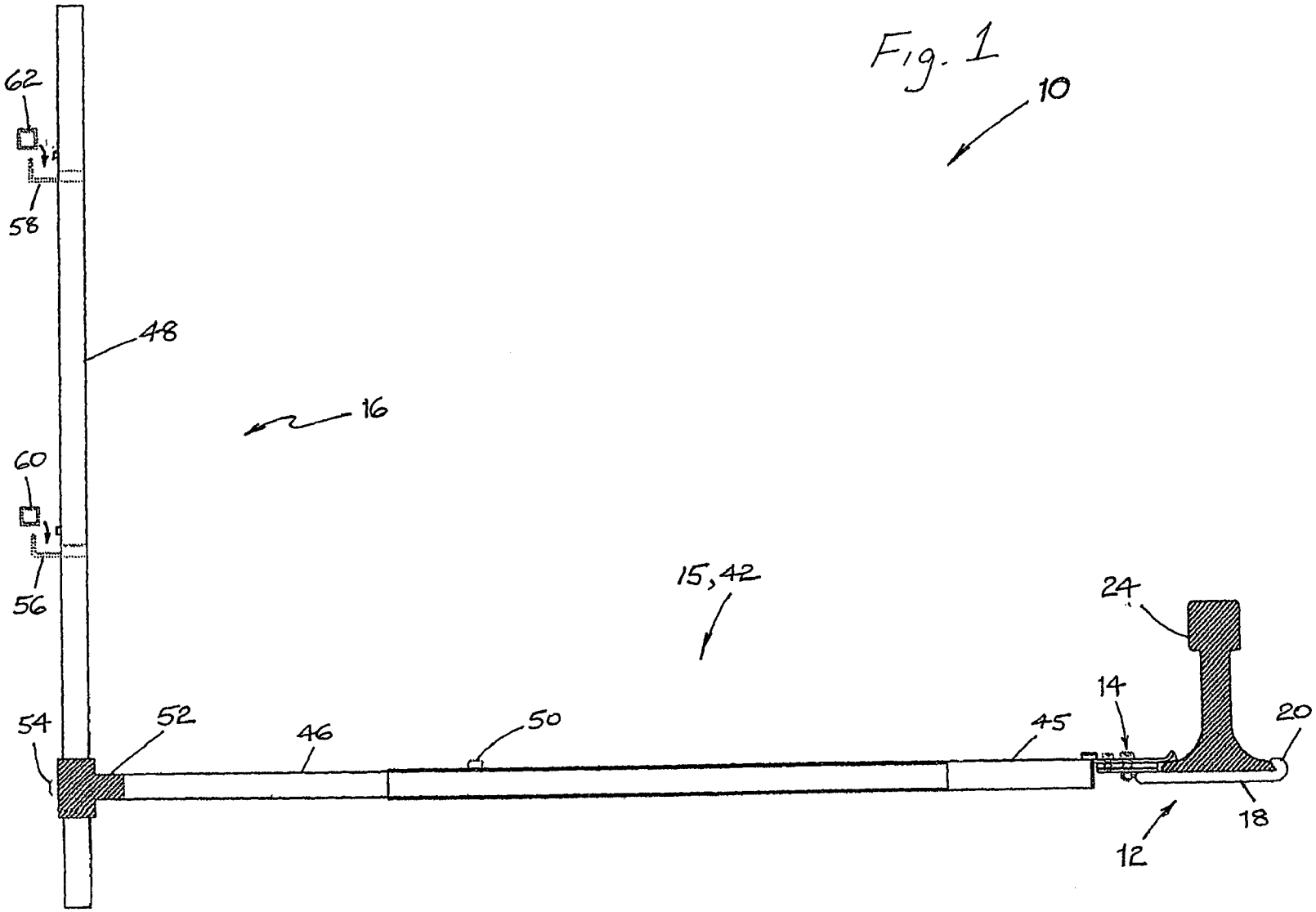
FIG. 1 is a side view of a post forming means and a pair of rail means of a guardrail assembly according to a preferred embodiment of the invention secured to a rail of a track.

The guardrail assembly comprises a plurality of post forming means 10, each post forming means 10 including a locking means 12 connected to the underside of a clamping means 14 which is, in turn, connected via a spacing means 15 to an upright post means 16.

The locking means 12 has a locating arm 18, at one end of which is a rail locating lug 20 and at the other end of which is an anti-tilt support arm 22. The locating arm 18 is slidably inserted under a single rail 24 of a track that is in use so that the lug 20 is located on the opposite side of the rail 24 to the clamping means 14 and abuts upwardly against the base of the rail 24.

The clamping means 14 has a top plate 26 which is overlaid on a rubber spacer 28 which, in turn, is overlaid on a circular bottom plate 30. There is a bolt 32 that passes through superimposed holes formed in the top plate 26, spacer 28, and bottom plate 30, and fastens them tightly together with a nut 34. The hole through the circular bottom plate 30 is located at its center. There is an adjustment slot 36 formed through the top plate 26 which receives an adjustment screw 38 therethrough for enabling the assembly to accommodate varying rail widths. The top plate 26 has an upturned corner 40 nearest the rail 24 which creates an enlarged opening for receiving the base part 64 of the rail 24 between the locating arm 18 and the top plate 26. The rubber spacer 28 serves to maintain grip between the top and bottom plates 26,30 and to reduce adverse vibrational effects on the assembly whenever a train or the like travels over the rail 24.

The spacing means 15 has a horizontal post 42 secured to the top plate 26. A strengthening block 44 is welded over adjoining parts of the horizontal post 42 and top plate 26. The horizontal post 42 is formed of a tubular outer arm 45 nearest the top plate 26 and a tubular inner arm 46 nearest an upright vertical post 48 of the upright post means 16, the inner arm 46 being telescopically movable through the outer arm 45 so as to adjust the length of the horizontal post 42. The desired length of the post 42 is maintained by a cap head bolt 50 (with a hexagonal key) that is screwed through superimposed holes formed in abutting upper surfaces of the outer and inner arms 45, 46. The resulting length of the horizontal post 42 should be sufficient to provide enough spatial separation between workers and the rail 24 of a track to avoid workers encroaching dangerously close to the track. The inner arm 46 is connected to the upright post 48 by a hollow T-joint 52. The horizontal post 42 may have its position adjusted along the upright post 48 by the tightening of a socket head screw 54.

The upright post 48 of the upright post means 16 has a pair of vertically spaced apart hook members 56,58 fixed thereto. Each of the hook members 56,58 supports thereon a length of safety rail 60,62 respectively, which safety rail is secured firmly against the upright post 48 by a tamper proof screw member or the like fitted through the upright portion of the hook member. A self tapping screw or a pin is fitted to the post 48 just above each of the so secured safety rails to prevent theft of the safety rails 60,62. The height of the upright post 48 may be about 1.2 m depending on the requirements of the user.

Figure 3:
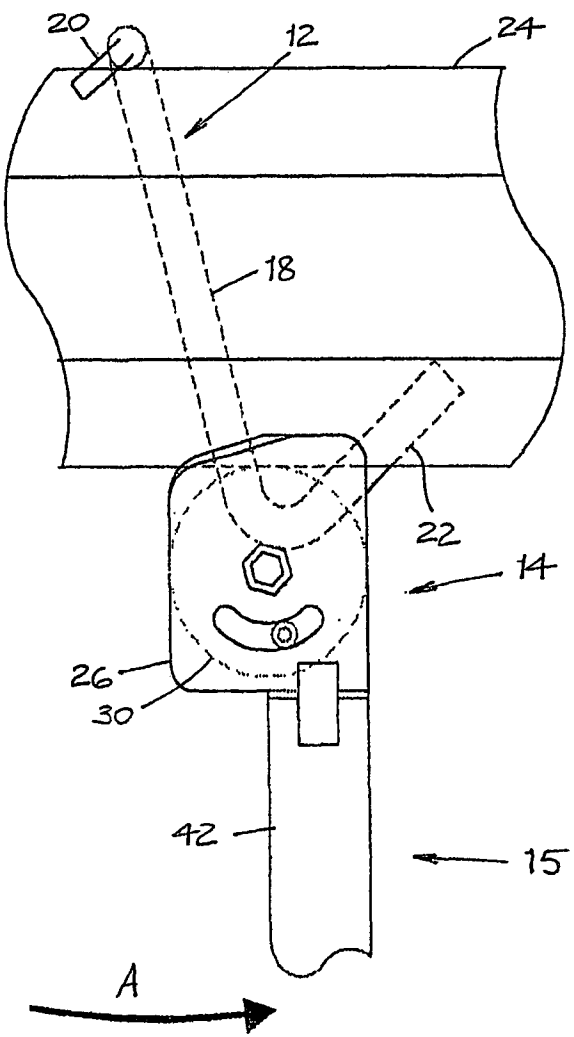
FIG. 3 is a plan view similar to FIG. 2 but in which the clamping means is in its second position where the locking means has locked the clamping means to the rail.
Figure 2:
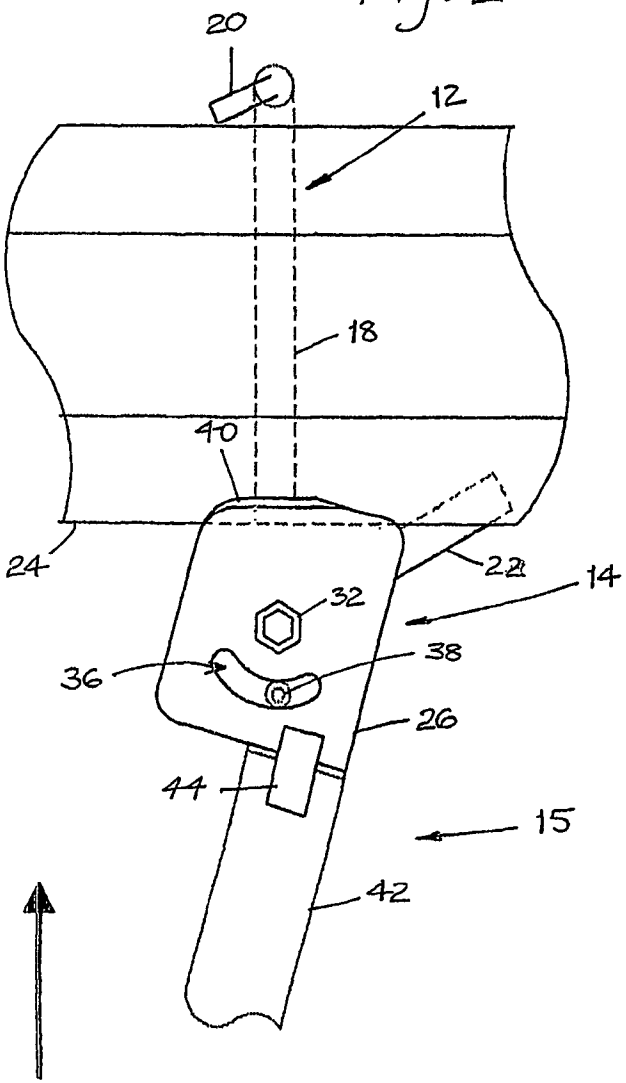
FIG. 2 is a plan view of a portion of the post forming means shown in FIG. 1 illustrating the locking means inserted under the rail and the clamping means in its first position.
Figure 4:
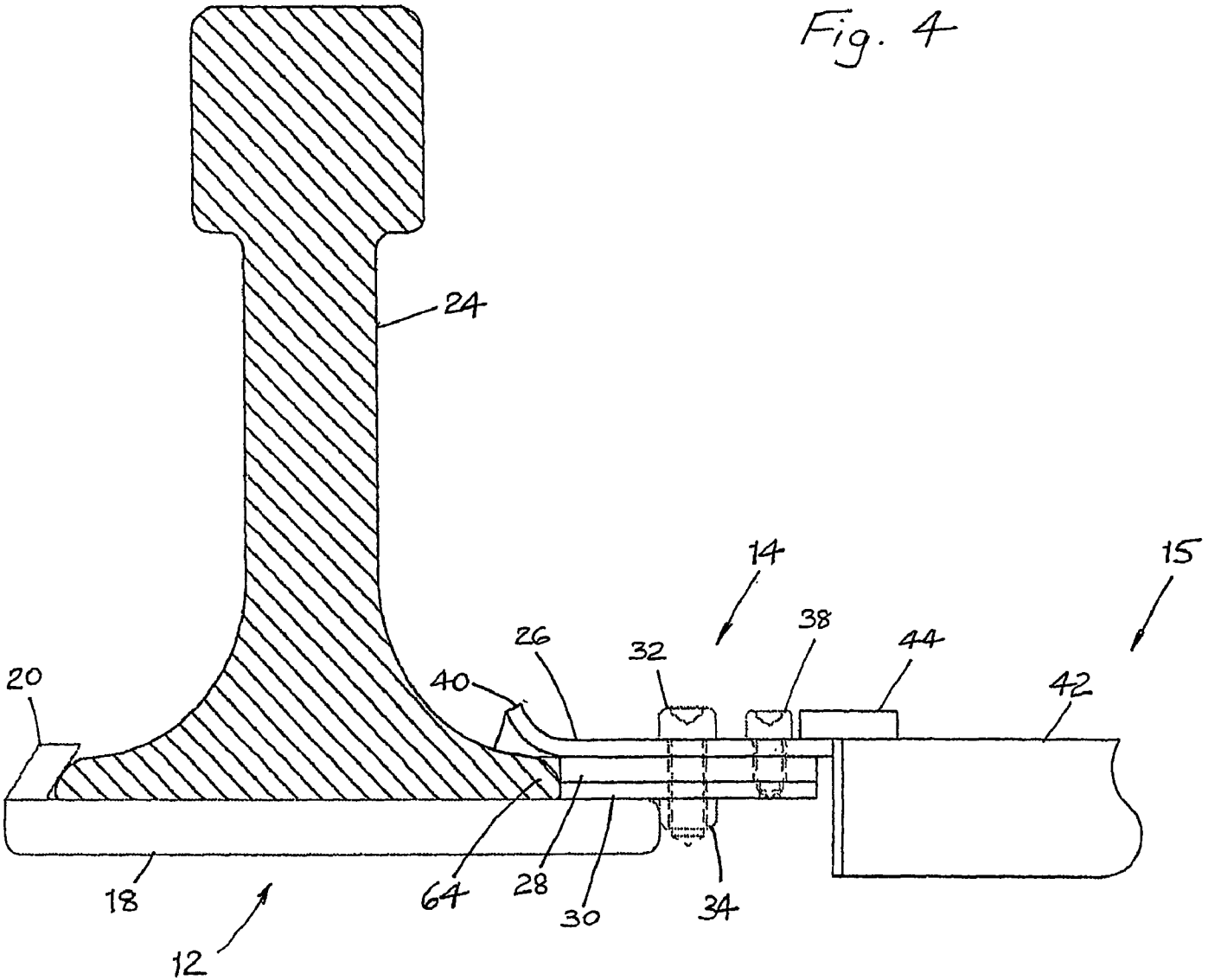
FIG. 4 is a side view of the portion of the post forming means and rail shown in FIG. 3.

As shown in FIGS. 2 and 3, the locating arm 18 extends in a longitudinal direction slightly away from the longitudinal axis of the horizontal post 42.

In order to clamp the post forming means 10 to the rail 24, the user firstly pushes (with relative ease) the locking means 12 under the rail 24 in a perpendicular direction to the rail 24, so that the lug 20 emerges upwardly at the other side of the rail, as shown in FIG. 2. A minimum amount of gravel is relocated as a result of this process given the thin and elongated nature of the locking means 12. The horizontal post 42 is then moved in the left to right sideways direction, as shown by arrow A in FIG. 3, so that the circumferential edge of the bottom plate 30 rides along the outermost edge of the base part 64 of the rail 24, until the base part 64 of the rail 24 is wedged tightly into the opening created between the upturned corner 40 of the top plate 26 and the locating arm 18. At this point the locating arm 18 and the support arm 22 have more firmly relocated under and adjacent the rail, the lug 20 more firmly abuts against the base of the rail, and the horizontal post 42 extends in a substantially perpendicular direction to the rail 24. The resulting location of the support arm 22 prevents any tendency for tilting of the clamping means 14 with respect to the rail 24. During this operation, the upright post 48 may or may not be connected to the horizontal post 42.

The operator then clamps a second post forming means to the rail 24 at a selected distance from where the first post forming means 10 is clamped to the rail. The second post forming means is, however, so formed that, instead of being movable from left to right (as is the first post forming means 10), it is movable from right to left in order to clamp it to the rail 24. Every second post forming means 10 is movable from right to left, whereas each intervening post forming means 10 is movable from left to right, thus creating a system where, once the safety rails 60,62 are secured to any three adjacent upright posts 48 in the manner mentioned earlier, if the intermediate post 48 has sideways pressure applied to it, it will be prevented from sideways movement off the ground by its two immediately opposed upright posts which are not movable in the same sideways direction.

The materials from which the various components of the guardrail assembly can be made will vary depending upon the requirements of the users and the nature of the power supply to the trains or the like travelling upon the rail. Where there are overhead power lines, the safety rails 60, 62 are preferably made from a non-conductive material, such as a polycarbonate, fiberglass or special purpose plastic, whereas the upright posts 48, horizontal posts 42, top and bottom plates 26, 30, and locking means 12 may be made from aluminum or steel. All steel components are preferably zinc plated to avoid corrosion. Where power is supplied in between the rails of a track, there should be insulation between the clamping means 14 of the assembly and the upright posts 48 provided, say, by having the horizontal posts 42 made of a polycarbonate, fiberglass or special purpose plastic. Both the locking means 12 and the clamping means 14 may also be made of a non-conductive material wherein they are connected by a molding process.

It will be apparent from the foregoing description of the guardrail assembly that such an assembly is quick and easy to install, and that it provides a less troublesome clamping mechanism than similar safety barriers of the prior art.

Various modifications may be made in details of design and construction without departing from the scope and ambit of the invention.

What is claimed is:

1. A guardrail assembly for securing to a rail of a track, with the rail having a base with an outermost edge, the guardrail assembly comprising:

(a) a plurality of post forming means, each post forming means including:

(i) locking means slidably insertable under the rail, the locking means including:

a locating arm that remains located under the rail after insertion of the locking means thereunder;

(ii) a top plate having an upturned corner portion, with the top plate and the upturned corner portion cooperating with the locking means to define an opening between the top plate and the locating arm, with the opening for receiving therebetween a first side portion of the rail;

(iii) a bottom plate separate and independent from the top plate and having a substantially circular shape with a circumferential edge, with the bottom plate being rotatable with the circumferential edge riding along the outermost edge of the base of the rail until the base of the rail is wedged tightly into the opening;

wherein the top and bottom plates are adapted to engage against the first side portion of the rail and to be moved between a first position, where the locking means is slidably removable from under the rail, and a second position, where the locking means locks the top and bottom plates to the rail;

wherein movement of the top and bottom plates to the second position causes the first side portion of the rail to be wedged tightly into the opening; and (iv) a spacer overlying the bottom plate to separate the bottom plate from the top plate;

(v) upright post means, and (vi) spacing means connected between the assembly of the top and bottom plates and the upright post means for locating the upright post means sufficiently remote of the rail to prevent a rail worker encroaching dangerously close to the rail, and (b) one or more rail means supported by the plurality of post forming means;

wherein the locking means of each of the plurality of post forming means includes:

a rail locating lug at a first end thereof; and a support arm at a second opposite end thereof nearest the assembly of the top and bottom plates, wherein the assembly of the top and bottom plates is moved from the first position to the second position, thereby causing the rail locating lug to firmly abut against a second side portion of the rail opposite the first side portion, and thereby causing the support arm to be firmly located under the rail; and wherein the bottom plate is rotated with the circumferential edge riding along the outermost edge of the base of the rail until the base of the rail is wedged tightly into the opening, thereby maintaining the support arm to be firmly located under the rail to prevent tilting.

2. The guardrail assembly of claim 1 wherein the rail locating lug is disposed at the first end furthest from the top and bottom plates; and wherein the locating arm is intermediate the first and second ends.

3. The guardrail assembly of claim 1 wherein the spacing means is telescopically extendable for adjustment of its length.

4. The guardrail assembly of claim 1 further comprising means for adjustment to adjust the top and bottom plates to suit varying widths of the rail.

5. The guardrail assembly of claim 1 wherein the spacer is composed of rubber.

* * * * *